US009464249B2

(12) United States Patent
Choo et al.

(10) Patent No.: US 9,464,249 B2
(45) Date of Patent: Oct. 11, 2016

(54) AVIATION FUEL COMPOSITION

(75) Inventors: Yuen May Choo, Selangor Darul Ehsan (MY); Sit Foon Cheng, Selangor Darul Ehsan (MY); Ah Ngan Ma, Selangor Darul Ehsan (MY); Yusof Basiron, Selangor Darul Ehsan (MY)

(73) Assignee: MALAYSIAN PALM OIL BOARD, Selangor Darul Ehsan (MY)

( * ) Notice: Subject to any disclaimer, the term of this patent is extended or adjusted under 35 U.S.C. 154(b) by 1658 days.

(21) Appl. No.: 12/085,555

(22) PCT Filed: Nov. 24, 2006

(86) PCT No.: PCT/MY2006/000030

§ 371 (c)(1),
(2), (4) Date: Jul. 29, 2008

(87) PCT Pub. No.: WO2007/061283

PCT Pub. Date: May 31, 2007

(65) Prior Publication Data

US 2009/0255172 A1 Oct. 15, 2009

(30) Foreign Application Priority Data

Nov. 28, 2005 (MY) ..... 20055540

(51) Int. Cl.
*C10L 1/18* (2006.01)
*C10L 1/02* (2006.01)

(52) U.S. Cl.
CPC ..... *C10L 1/02* (2013.01); *C10G 2300/203* (2013.01); *C10G 2300/304* (2013.01)

(58) Field of Classification Search
CPC ..... C10L 1/02; C10G 2300/203; C10G 2300/304
USPC ..... 44/321, 388, 393, 395, 408, 418
See application file for complete search history.

(56) References Cited

U.S. PATENT DOCUMENTS

| | | | | |
|---|---|---|---|---|
| 2004/0020106 | A1* | 2/2004 | Tack et al. | 44/393 |
| 2005/0044778 | A1* | 3/2005 | Orr | 44/320 |
| 2005/0183325 | A1* | 8/2005 | Sutkowski | 44/418 |
| 2005/0188605 | A1* | 9/2005 | Valentine et al. | 44/321 |
| 2007/0167642 | A1* | 7/2007 | Oku et al. | 554/174 |

FOREIGN PATENT DOCUMENTS

| | | | |
|---|---|---|---|
| GB | 2 090 611 | A | 7/1982 |
| WO | WO-01/36354 | A1 | 5/2001 |
| WO | WO-02/10317 | A1 | 2/2002 |

* cited by examiner

*Primary Examiner* — Latosha Hines
(74) *Attorney, Agent, or Firm* — Birch, Stewart, Kolasch & Birch, LLP

(57) ABSTRACT

The present invention relates to an aviation fuel composition comprising a) a jet fuel;
b) an alkyl ester or a mixture of alkyl esters obtained from reaction between
   i) saturated fatty acids with carbon chain length ranging from 8 to 10 ($C_8$-$C_{10}$ saturated fatty acids); and
   ii) monohydric alcohols with carbon chain length ranging from 1 to 4 ($C_1$-$C_4$ monohydric alcohols);

wherein the alkyl ester or mixture of alkyl esters can be blended with jet fuel in an amount up to 50% (vol/vol).

8 Claims, No Drawings

AVIATION FUEL COMPOSITION

FIELD OF INVENTION

The present invention relates to an aviation fuel composition, more particularly, to an aviation fuel composition comprising biofuel.

BACKGROUND OF THE INVENTION

Aviation turbine fuels (also known as jet fuels) are used for powering turbine engine aircraft. One of the key performance properties of jet fuels is their fluidity measured in terms of freezing point and viscosity.

For powering civilian or commercial aircraft, there are two main grades of jet fuel: Jet A-1 and Jet A. Jet fuels of both grades are kerosene-type fuel and the difference between them is that jet fuel of grade Jet A-1 fulfills the freezing point requirement of maximum −47° C. whereas jet fuel of grade Jet A fulfills the freezing point requirement of maximum −40° C. There is another grade of jet fuel: Jet B for usage in very cold climate. Jet fuel of grade Jet B is a wide-cut fuel covering fractions from naphtha and kerosene, which fulfills the freezing point requirement of maximum −50° C.

Greener jet fuels are being sought for replacing the existing petroleum-based jet fuels. Several alternatives have been considered for this purpose. The alternatives considered are alcohols including methanol and ethanol; cryogenic fuels including hydrogen and methane; and biofuel including vegetable oils and methyl esters derived from vegetable oils. For feasible replacement of the existing petroleum-based jet fuels, such alternatives must be compatible with the quality requirements of existing aircrafts, for example, they must have sufficient energy content and adequate lubricity and they must also be compatible with all the materials used in the engine's fuel system.

Alcohols are impractical as jet fuel because of their low volumetric energy content and their chemical incompatibility with materials used in the engine's fuel system. Furthermore, alcohols have very low flash point making them very hazardous to be used.

Cryogenic fuels are not compatible with the fueling system of existing aircrafts. Introduction of any cryogenic fuel as jet fuel would require the design and development of new aircraft as well as new supporting airport infrastructure for the storage and handling of such fuel. Cryogenic fuels also have low volumetric energy content making it necessary for the new aircraft to have larger fuel tank than existing aircrafts to take up a larger fuel load.

Although vegetable oils have the highest volumetric energy content among the alternatives considered but they are totally unsuitable to be used as jet fuel because they cannot meet the freezing point requirement. Even when methyl esters derived from vegetable oils are used, they can only be added to jet fuel in an amount of not more than 2%. If they are added in an amount of more than 2%, the resultant fuel blend would fail the freezing point requirement.

Till present, there is no feasible alternative for the existing petroleum-based jet fuel.

SUMMARY OF THE INVENTION

The present invention relates to an aviation fuel composition comprising a) a jet fuel;
b) an alkyl ester or a mixture of alkyl esters obtained from reaction between
   i) saturated fatty acids with carbon chain length ranging from 8 to 10 ($C_8$-$C_{10}$ saturated fatty acids); and
   ii) monohydric alcohols with carbon chain length ranging from 1 to 4 ($C_1$-$C_4$ monohydric alcohols);

wherein the alkyl ester or mixture of alkyl esters can be blended with jet fuel in an amount up to 50% (vol/vol).

The jet fuel can be a kerosene-type fuel or a wide-cut fuel.

The $C_8$-$C_{10}$ saturated fatty acids are selected from the group comprising caprylic ($C_8$) acid and capric ($C_{10}$) acid, or a mixture thereof.

The $C_1$-$C_4$ monohydric alcohols are selected from the group comprising methanol, ethanol, propanol, isopropanol, butanol, isobutanol and t-butanol, or mixtures thereof. Preferably, the $C_1$-$C_4$ monohydric alcohols are selected from those having branch-chain structure, for example isopropanol, isobutanol and t-butanol, or mixtures thereof.

The alkyl ester or mixture of alkyl esters preferably has ester content of not less than 99% and acidity of not more than 0.10 mg KOH/g.

The aviation fuel composition fulfills the freezing point requirement of: not higher than −40° C. for jet fuel of grade Jet A; not higher than −47° C. for jet fuel of grade Jet A-1; not higher than −50° C. for jet fuel of grade Jet B.

The aviation fuel composition fulfills the ASTM Standard Specification D 1655 for Aviation Turbine Fuels.

DETAILED DESCRIPTION OF THE INVENTION

The present invention relates to an aviation fuel composition which comprises a) a jet fuel;
b) an alkyl ester or a mixture of alkyl esters obtained from reaction between
   i) saturated fatty acids with carbon chain length ranging from 8 to 10 (hereinafter referred to as $C_8$-$C_{10}$ saturated fatty acids); and
   ii) monohydric alcohols with carbon chain length ranging from 1 to 4 (hereinafter referred to as $C_1$-$C_4$ monohydric alcohols);

wherein the alkyl ester or mixture of alkyl esters can be blended with jet fuel in an amount up to 50% (vol/vol).

The jet fuel can be a kerosene-type fuel or a wide-cut fuel. The $C_8$-$C_{10}$ saturated fatty acids are particularly caprylic ($C_8$) acid and capric ($C_{10}$) acid. These fatty acids can be derived from vegetable oils especially palm oil, palm kernel oil and coconut oil.

The $C_1$-$C_4$ monohydric alcohols can be straight-chained or branch-chained. They are selected from the group comprising methanol, ethanol, propanol, isopropanol, butanol, isobutanol and t-butanol, or mixtures thereof. Preferably, they are selected from those having branch-chain structure, for example isopropanol, isobutanol and t-butanol.

The alkyl ester or mixture of alkyl esters are produced according to known methods. Preferably, they have ester content of not less than 99% and acidity of not more than 0.10 mg KOH/g.

The aviation fuel composition of present invention fulfills the quality requirements for jet fuels of grade Jet A-1, Jet A and Jet B. With addition of suitable additives such as fuel system icing inhibitor, the aviation fuel composition can even fulfill the requirements for certain grades of military jet fuels, for example military jet fuel of grade JP-8.

As the alkyl ester or mixture of alkyl esters used in the aviation fuel composition of present invention are derived from vegetable oils, they are considered vegetable oil derivatives which is a form of renewable fuel. For the first time, a suitable jet fuel has been successfully developed from blending vegetable oil derivatives with conventional jet fuels. It is now possible to blend up to 50% of the vegetable oil derivatives with conventional jet fuels and the resultant blends are still able to meet the freezing point requirement for all grades of commercial jet fuels. A reduced consumption of petroleum-based jet fuels would be seen if the aviation fuel composition of present invention is used in place of conventional jet fuels.

Various embodiment of the aviation fuel composition of present invention are presented as examples in a non-limiting sense.

Example 1

Freezing points of the alkyl ester or mixture of alkyl esters obtained from reaction between $C_8$-$C_{10}$ saturated fatty acids and $C_1$-$C_4$ monohydric alcohols are determined according to ASTM D 2386 and tabulated in Table 1.

TABLE 1

| ALKYL ESTER OR MIXTURE OF ALKYL ESTERS | FREEZING POINT (° C.) |
|---|---|
| Methyl Caprylate | −35.5 |
| Isopropyl Caprylate | −50 |
| n-Butyl Caprylate | −43 |
| 2-Butyl Caprylate | −50 |
| Isobutyl Caprylate | −55 |
| 2-Butyl Caprate | −39 |
| Mixture of n-Butyl Caprylate and n-Butyl Caprate | −31 |

Example 2 n-Butyl Caprylate is blended with a jet fuel of grade Jet A-1 in an amount of 50% (vol/vol). Various properties of the resultant blend are determined according to ASTM test methods used for jet fuel specification testing. The properties determined are listed in Table 2 and they are being compared ASTM Standard Specification D 1655 for Aviation Turbine Fuels.

TABLE 2

| Properties | Test Method | Unit | Jet A-1 | n-Butyl Caprylate | n-Butyl Caprylate:Jet A-1 (50:50) | Standard Specification ASTM D 1655 |
|---|---|---|---|---|---|---|
| Purity | GC | % | — | 99.99 | — | — |
| Density at 15° C. | ASTM D4052 | kg/L | 0.7931 | 0.8666 | 0.8299 | 0.775-0.840 |
| Flash Point | ASTM D93 | ° C. | 42.0 | 102.0 | 53.0 | Min 38 |
| Viscosity at −20° C. | ASTM D445 | cSt | 3.383 | 7.400 | 4.796 | Max 8 |
| Freezing Point | ASTM D2386 | ° C. | −54.0 | −43.0 | −50.0 | Max - 47 (Jet A-1)<br>Max - 40 (Jet A)<br>Max - 50 (Jet B) |
| Interface Rating | ASTM D1094 | — | 1 | 1b | 1b | 1 |
| Existent Gum | ASTM D381 | mg/100 ml | 1 | 5 | 1 | Max 7 |
| Copper Strip Corrosion | ASTM D130 | — | 1a | 1a | 1a | 1 |
| Electric Conductivity at 25° C. | ASTM D2624 | pS/m | 78 | 440 | 420 | Max 450 |
| Appearance | — | — | Colourless | Light Yellow | Light Yellow | Colourless |

Example 3

2-Butyl Caprylate is blended with a jet fuel of grade Jet A-1 in an amount of 50% (vol/vol). Various properties of the resultant blend are determined according to ASTM test methods used for jet fuel specification testing. The properties determined are listed in Table 3 and they are being compared ASTM Standard Specification D 1655 for Aviation Turbine Fuels.

TABLE 3

| Properties | Test Method | Unit | Jet A-1 | 2-Butyl Caprylate | 2-Butyl Caprylate:Jet A-1 (50:50) | Standard Specification ASTM D 1655 |
|---|---|---|---|---|---|---|
| Purity | GC | % | — | 99.97 | — | — |
| Density at 15° C. | ASTM D4052 | kg/L | 0.7931 | 0.8609 | 0.8299 | 0.775-0.840 |
| Flash Point | ASTM D93 | ° C. | 42.0 | 93.0 | 53.0 | Min 38 |

TABLE 3-continued

| Properties | Test Method | Unit | Jet A-1 | 2-Butyl Caprylate | 2-Butyl Caprylate:Jet A-1 (50:50) | Standard Specification ASTM D 1655 |
|---|---|---|---|---|---|---|
| Viscosity at −20° C. | ASTM D445 | cSt | 3.383 | 7.135 | 4.796 | Max 8 |
| Freezing Point | ASTM D2386 | ° C. | −54.0 | −50.0 | −50.0 | Max - 47 (Jet A-1)<br>Max - 40 (Jet A)<br>Max - 50 (Jet B) |
| Interface Rating | ASTM D1094 | — | 1 | 1b | 1b | 1 |
| Existent Gum | ASTM D381 | mg/100 ml | 1 | 7 | 4 | Max 7 |
| Copper Strip Corrosion | ASTM D130 | — | 1a | 1a | 1a | 1 |
| Electric Conductivity at 25° C. | ASTM D2624 | pS/m | 78 | 420 | 400 | Max 450 |
| Appearance | — | — | Colourless | Light Yellow | Light Yellow | Colourless |

The invention claimed is:

1. An aviation fuel composition comprising a) a jet fuel;

b) one or more alkyl esters obtained from a reaction between:

i) $C_8$-$C_{10}$ saturated fatty acids; and ii) $C_1$-$C_4$ monohydric alcohols;

wherein the one or more alkyl esters is selected from the group consisting of methyl caprylate, isopropyl caprylate, 2-butyl caprylate, isobutyl caprylate, n-butyl caprylate, and 2-butyl caprate;

wherein the one or more alkyl esters is blended with jet fuel in an amount up to 50% (vol/vol).

2. An aviation fuel composition as claimed in claim 1 wherein the jet fuel is a kerosene-type fuel or a wide-cut fuel.

3. An aviation fuel composition as claimed in claim 1 wherein the one or more alkyl esters has ester content of not less than 99%.

4. An aviation fuel composition as claimed in claim 3 wherein the one or more alkyl esters has acidity of not more than 0.10 mg KOH/g.

5. The aviation fuel composition as claimed in claim 1, wherein the aviation fuel composition has a freezing point of not higher than −40° C.

6. The aviation fuel composition as claimed in claim 5, wherein the aviation fuel composition has a freezing point of not higher than −47° C.

7. The aviation fuel composition as claimed in claim 6, wherein the aviation fuel composition has a freezing point of not higher than −50° C.

8. The aviation fuel composition as claimed in claim 1, wherein the aviation fuel composition fulfills the ASTM Standard Specification D 1655 for Aviation Turbine Fuels.

* * * * *